United States Patent [19]

Pilkington

[11] 4,058,008

[45] Nov. 15, 1977

[54] YARN TENSION TRANSDUCER

[75] Inventor: John Scott Pilkington, Cheadle, England

[73] Assignee: Abbey Electronics Limited, England

[21] Appl. No.: 728,013

[22] Filed: Sept. 29, 1976

[30] Foreign Application Priority Data

Oct. 4, 1975 United Kingdom ..... 40729/75

[51] Int. Cl.[2] ..... G01L 5/04

[52] U.S. Cl. ..... 73/144

[58] Field of Search ..... 73/144, 143

[56] References Cited

U.S. PATENT DOCUMENTS

| | | | |
|---|---|---|---|
| 2,809,519 | 10/1957 | Kaestner | 73/144 |
| 3,280,623 | 10/1966 | Saxl | 73/144 |
| 3,376,740 | 4/1968 | Harvey | 73/144 |

*Primary Examiner*—James J. Gill
*Assistant Examiner*—Anthony V. Ciarlante
*Attorney, Agent, or Firm*—Michael J. Striker

[57] ABSTRACT

A yarn tension transducer comprises a movable yarn guide against which a running yarn touches and which is under a biasing force towards the yarn, movements of the guide in response to yarn tension fluctuations being converted electrically into an induction of yarn tension values.

6 Claims, 3 Drawing Figures

FIG.1.
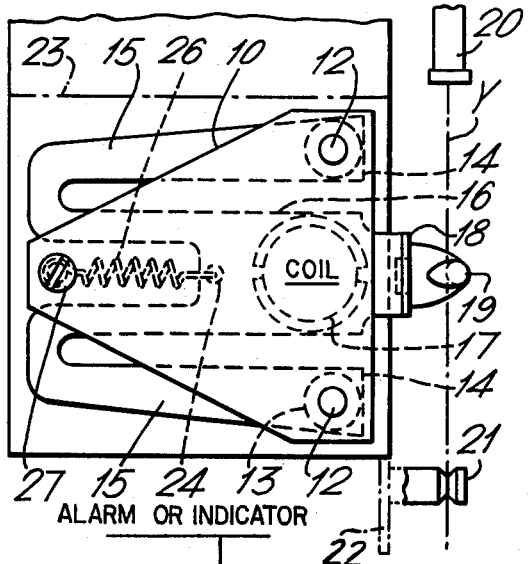
FIG.2.
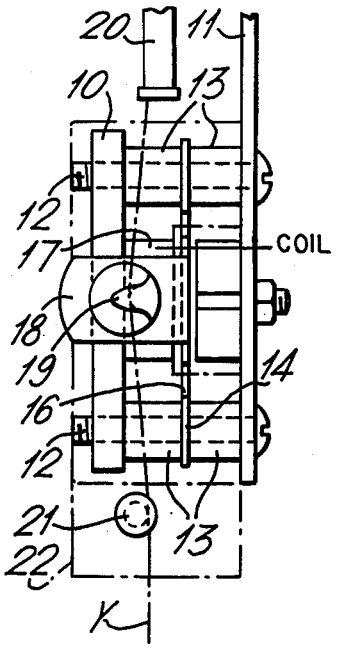
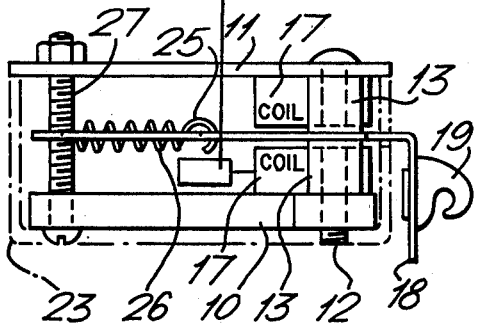
FIG.3.

YARN TENSION TRANSDUCER

This invention relates to a transducer for measuring tension in a running strand, and especially the tension present in a running yarn immediately downstream of a friction false-twisting device such as is described in British patent specification No. 1,381,132, and which comprises sets of overlapping friction discs on three parallel equally spaced shafts, the degree of overlap of the discs and their axial spacing one from another being such that a yarn being friction false-twisted follows a helical spiralling path over the disc rims.

In general there can be many reasons for requiring to know the tension existing in a running strand, but in the context of the tension present in a running yarn downstream of a friction false-twisting device, as described above, we have discovered that if the tension lies outside a fairly narrow range representing an optimum processing range for any particular yarn, this indicates that somewhere in the threadline of that yarn there is some item of equipment requiring attention and that the yarn is not being processed satisfactorily, even up to the point that the end product of that threadline will be commercially unacceptable waste yarn. It could be for example that the false-twisting device has become faulty by wear or that a yarn guide needs attention or exchange.

We have further discovered that threadline faults can also be detected as existing even when the tension value lies within the desired range but is fluctuating in a sense which indicates that tension is surging. The yarn tension always fluctuates anyway, and we have further observed that both regular low frequency tension fluctuations and regular high frequency tension fluctuations are quite acceptable within the desired range, but that irregular fluctuations constantly changing between low and high frequencies again indicate threadline faults even if the actual tension values lie within the desired range.

In a yarn tension transducer according to this invention the running yarn touches against a movable yarn guide which is under a biasing force towards the yarn and movements of the guide in either of two opposite directions in response to yarn tension fluctuations are converted electrically into an indication of yarn tension values.

In the accompanying drawings:

FIG. 1 is a side view of a yarn tension transducer.

FIG. 2 is a front view of FIG. 1 and FIG. 3 is a plan view of FIG. 1.

Referring to FIGS. 1 to 3, which show the preferred embodiment, a support plate 10 is secured in spaced relation to a base plate 11 by screws 12. Two spacer sleeves 13 upon each screw 12 clamp between them the respective ends 14 of the two outer arms 15 of a springy thin plate of ferromagnetic material such as spring steel, the plate being generally of W shape, as seen most clearly in FIG. 1.

The central portion 16 of this W-shaped plate extends to lie between the two outer arms 15, and this central portion lies between respective similar electrical induction coils 17 mounted opposite each other, one on the base plate 11 and one on the support plate 10.

Thus it will be seen that the central portion 16 of the W-shape spring plate can operate as a spring-loaded armature, as later described.

A right-angular extension 18 of the central portion 16 of the W-shape plate is apertured to receive a movable yarn guide 19, which is shown as of hook shape for easy threading up but could be of any suitable form.

The yarn guide tube 20 seen in FIGS. 1 and 2 is the outlet member of a friction false-twisting device previously mentioned and for this tension transducer acts as a fixed yarn guide from which yarn Y indicated in chain-dot lines runs over the movable yarn guide 19 of the transducer and then over another fixed yarn guide 21, the latter being shown as a grooved pin carried on an extension 22 of a cover 23 indicated in chain-dot lines.

It will be understood that the two induction coils 17 are in electrical circuitry (not shown) capable of indicating yarn tension values derived from the instantaneous position of the armature (provided by the central portion 16 of the W-shape spring plate) between the opposed coils, such position being dependent upon the yarn tension value producing a corresponding displacement of the armature from a datum or zero position of balance between the two coils.

Considering the movable yarn guide 19 to be at the forward end of the armature portion 16, the rearward end of the latter has a hole 24 in which is hooked the forward end eye 25 of a coiled extension spring 26 (FIGS. 1 and 3). The other rearward end eye (not shown) of the spring 26 is hooked about the threaded portion of a screw 27 rotatably mounted to extend between the support plate 10 and base plate 11.

Rotation of the screw causes the rearward eye of the spring to be moved along the screw thread, and the central armature portion 16 of the W-shape spring plate can thus be adjusted one way or the other to set its datum or zero position between the two induction coils.

The transducer is threaded up with yarn Y as seen in FIG. 2. The yarn bears lightly on the movable guide 19 and deflects it (to the right in FIG. 2) against the inherent bias force of the W-shape spring plate. The electrical circuitry associated with the coils 17 produces an output quantity representative of the magnitude of deflection of the armature portion 16, which deflection is itself representative of the value of yarn tension, the latter being indicated by the electrical circuitry in any suitable display manner, which preferably includes alarm display should the yarn tension lie outside a desired ranger, e.g. 4 to 6 grams, or if yarn tension fluctuations within the desired range are of fluctuating frequency of undesirable irregularity.

It is believed that circuitry suitable for these purposes could be of many different forms, generally well-known to those skilled in the electrical and electronic arts.

What we claim is:

1. A yarn tension transducer comprising a movable yarn guide against which a running yarn touches and which is under a biasing force towards the yarn, movement of the guide in either of two opposite directions in response to yarn tension fluctuations being converted electrically into an indication of yarn tension values, the yarn guide being mounted on a springy thin plate which is of ferromagnetic material and generally of W shape with a central portion between two outer arms, the plate being clamped by the respective ends of the two outer arms, and the yarn guide being carried at a forward end of the central portion with the latter lying between two similar electrical induction coils located opposite one another, whereby the central portion of the plate operates as a spring-loaded armature.

2. Yarn tension transducer according to claim 1, wherein a rearward end of the central portion of the plate is connected to one forward end of a coiled extension spring, the other rearward end of the extension spring being connected with a rotatable screw by an eye of the spring hooked about the screw, whereby the central armature portion of the plate can be adjusted one way or the other to set its position between the two induction coils.

3. A yarn tension transducer according to claim 1, wherein said thin plate is made of spring steel.

4. A yarn tension transducer according to claim 1, wherein said yarn guide has a hook shape.

5. A yarn tension transducer according to claim 1, further comprising alarm means operatively connected with said central portion for giving notice of undesirable yarn tension.

6. A yarn tension transducer according to claim 1, further comprising a support plate, a base plate and a plurality of spacer means for spacing said support plate and said base plate and also for clamping, between said spacer means, the respective ends of the two outer arms of the springy thin plate.

* * * * *